US011221577B2

(12) United States Patent
Bui et al.

(10) Patent No.: US 11,221,577 B2
(45) Date of Patent: Jan. 11, 2022

(54) SHEET FEEDING CASSETTE, IMAGE FORMING APPARATUS

(71) Applicant: KYOCERA Document Solutions Inc., Osaka (JP)

(72) Inventors: Dang Long Bui, Osaka (JP); Arata Nakamura, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 16/930,501

(22) Filed: Jul. 16, 2020

(65) Prior Publication Data

US 2021/0026285 A1 Jan. 28, 2021

(30) Foreign Application Priority Data

Jul. 22, 2019 (JP) ..... JP2019-134815

(51) Int. Cl.
*G03G 15/00* (2006.01)
*B65H 1/26* (2006.01)

(52) U.S. Cl.
CPC ..... *G03G 15/6502* (2013.01); *B65H 1/266* (2013.01); *B65H 2405/11161* (2013.01); *G03G 2215/00383* (2013.01)

(58) Field of Classification Search
CPC ..... G03G 15/6502; G03G 2215/00383; B65H 1/266; B65H 1/14; B65H 1/26; B65H 2511/242; B65H 31/34; B65H 2301/331; B65H 5/38; B65G 7/08
See application file for complete search history.

(56) References Cited

U.S. PATENT DOCUMENTS 4,826,147 A * 5/1989 Shino ..... B65H 1/04 271/145
5,228,676 A 7/1993 Arai et al.
6,123,329 A * 9/2000 Sato ..... B65H 1/14 271/145
6,142,689 A * 11/2000 Margiotta ..... B65H 1/04 400/624
6,837,490 B2 * 1/2005 Hirai ..... B65H 1/04 271/148
7,410,159 B2 * 8/2008 Miyazaki ..... B65H 1/14 271/110
7,618,037 B2 * 11/2009 Kang ..... B65H 1/08 271/157
9,272,857 B2 * 3/2016 Nakagawa ..... B65H 1/14
(Continued)

FOREIGN PATENT DOCUMENTS

JP H0524673 A 2/1993

*Primary Examiner* — Gregory W Adams
(74) *Attorney, Agent, or Firm* — Studebaker & Brackett PC

(57) ABSTRACT

The sheet feeding cassette includes a cassette frame, a first lift plate and a second lift plate. The cassette frame includes a bottom plate and side plates extending in the feeding direction. The bottom plate and the side plates form a sheet placement space. The first lift plate is disposed on the bottom plate, configured to rotate up and down around a first axis extending along a width direction perpendicular to the feeding direction, and configured to lift a leading end portion in the feeding direction of the sheet. The second lift plate is configured to rotate up and down around a second axis extending along the feeding direction and to lift a side end portion along the feeding direction of the sheet.

7 Claims, 12 Drawing Sheets

(56) References Cited

U.S. PATENT DOCUMENTS

| | | | | |
|---|---|---|---|---|
| 9,611,110 | B2 * | 4/2017 | Nishioka | B65H 1/08 |
| 2009/0243196 | A1 * | 10/2009 | Kawamoto | B65H 1/14 271/147 |

* cited by examiner

SHEET FEEDING CASSETTE, IMAGE FORMING APPARATUS

INCORPORATION BY REFERENCE

This application is based on and claims the benefit of priority from Japanese Patent application No. 2019-134815 filed on Jul. 22, 2019, which is incorporated by reference in its entirety.

TECHNICAL FIELD

The present disclosure relates to a sheet feeding cassette and an image forming apparatus.

BACKGROUND

An image forming apparatus such as a printer and a multifunctional peripheral is provided with a sheet feeding cassette which stores a sheet stack containing a plurality of sheets. As a sheet feeding cassette of this type, one in which a bottom plate of a cassette frame is turned to lift up the sheet stack placed on the bottom plate is known. By putting the sheet feeding cassette in the image forming apparatus, an input side and an output side of a driving force transmission mechanism to turn the bottom plate of the cassette frame are coupled with each other. At the operation of the image forming apparatus, the bottom plate of the cassette frame is pushed up by a driving force of the driving force transmission mechanism, and the upper surface of the sheet stack is positioned at a sheet feeding position of a pickup roller.

SUMMARY OF THE INVENTION

In accordance with one aspect of the present disclosure, a sheet feeding cassette is attached to an apparatus main body in a detachable manner, and on the sheet feeding cassette, which a sheet to be fed in a predetermined feeding direction is placed. The sheet feeding cassette includes a cassette frame, a first lift plate and a second lift plate. The cassette frame includes a bottom plate and side plates extending in the feeding direction. The bottom plate and the side plates form a sheet placement space. The first lift plate is disposed on the bottom plate, configured to rotate up and down around a first axis extending along a width direction perpendicular to the feeding direction, and configured to lift a leading end portion in the feeding direction of the sheet. The second lift plate is configured to rotate up and down around a second axis extending along the feeding direction and to lift a side end portion along the feeding direction of the sheet.

In accordance with one aspect of the present disclosure, an image forming apparatus includes the sheet feeding cassette and an image forming part which forms an image on the sheet fed from the sheet feeding cassette.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

Figure 1:
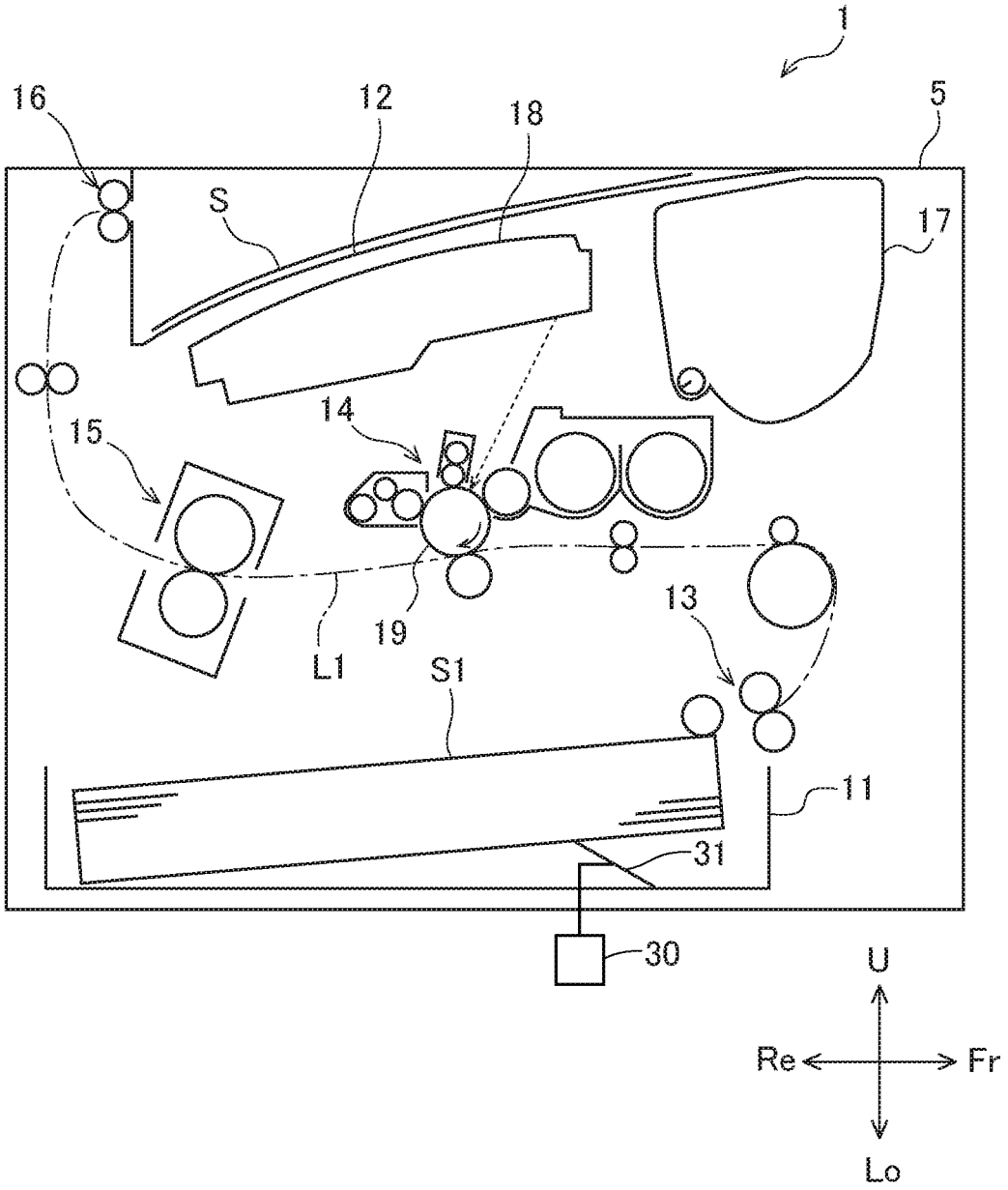
FIG. 1 is a view schematically showing a printer in the present embodiment.

Hereinafter, with reference to the attached drawings, an image forming apparatus provided with a sheet feeding cassette in the present embodiment will be described. In the following description, a printer as an example of the image forming apparatus will be described. FIG. 1 is a view schematically showing the printer in the present embodiment. Arrows Fr, Re, L, R, U and Lo marked in each figure respectively show a front side, a rear side, a left side, a right side, an upper side and a lower side of the printer.

As shown in FIG. 1, the printer 1 includes a box-shaped housing 5 in which various devices are stored. In the lower portion of the housing (an apparatus main body) 5, a sheet feeding cassette 11 in which a sheet S to be fed in a predetermined feeding direction is placed is stored in a detachable manner, and in the upper portion of the housing 5, a discharge tray 12 is provided. In the housing 5, a conveyance path L1 for the sheet S is formed by a plurality of rollers from the sheet feeding cassette 11 to the discharge tray 12. On the conveyance path L1, a sheet feeding device 13, an image forming part 14, a fixing device 15 and a discharge device 16 are provided from the upstream side to the downstream side. Above the image forming part 14, a toner container 17 and an exposure device 18 are provided.

At an image forming operation of the printer 1, the exposure device 18 emits laser light on a photosensitive drum 19 of the image forming part 14, and an electrostatic latent image is formed on the surface of the photosensitive drum 19. Then, a toner is supplied to the electrostatic latent image, and a toner image is formed on the surface of the photosensitive drum 19. On the other hand, the sheet S is fed by the sheet feeding device 13 from the sheet feeding cassette 11, and then conveyed to the image forming part 14 with a timing of the image forming operation. In the image forming part 14, the toner image is transferred from the surface of the photosensitive drum 19 to the surface of the sheet S. Then, the toner image is fixed to the sheet S in the fixing device 15, and the sheet S having the fixed toner image is discharged by the discharge device 16 on the discharge tray 12.

Figure 2:
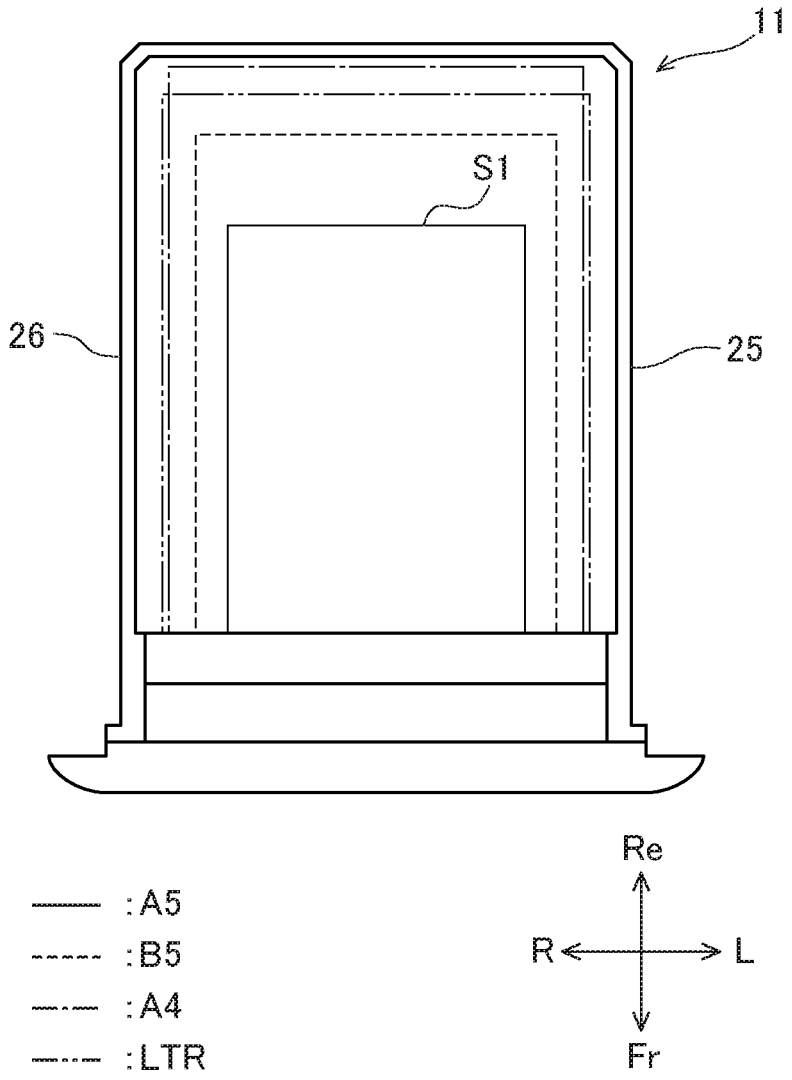
FIG. 2 is a view showing a sheet stack in a setting state in a sheet feeding cassette in a comparative embodiment.

In some cases where the sheet feeding cassette 11 is pulled out of the above printer 1 and then the sheet stack S1 is taken out of the sheet feeding cassette 11, if the sheet stack S1 set in the sheet feeding cassette 11 has a large size, it becomes difficult to take the sheet stack S1 out of the sheet feeding cassette 11. For example, as shown in FIG. 2, if the sheet stack S1 has a size smaller than the A5 size, a sufficient space for inserting a finger can be secured between the side plates 25 and 26 of the sheet feeding cassette 11 and the sheet stack S1. On the other hand, if the sheet stack S1 has a size larger than the A5 size, such as the B5 size, the A4 size, the LTR size and the LGL size, a sufficient space for inserting a finger cannot be secured between the side plates 25 and 26 of the sheet feeding cassette 11 and the sheet stack S1.

When the sheet stack S1 having a large size is taken out of the sheet feeding cassette 11, it is considerable that the finger is inserted into a narrow space between the side plates 25 and 26 of the sheet feeding cassette 11 and the sheet stack S1. If the sheet stack S1 is forcefully taken out of the sheet feeding cassette 11, the sheet stack S1 may be damaged to cause a conveyance failure or a printing failure. Then, the sheet feeding cassette 11 of the present embodiment is provided with a sheet taking out mechanism 50 (refer to FIG. 3) which lifts up the sheet stack S1 higher than the side plates 25 and 26 of the sheet feeding cassette 11 to allow smoothly taking out of the sheet stack S1 from the sheet feeding cassette 11.

Figure 3:
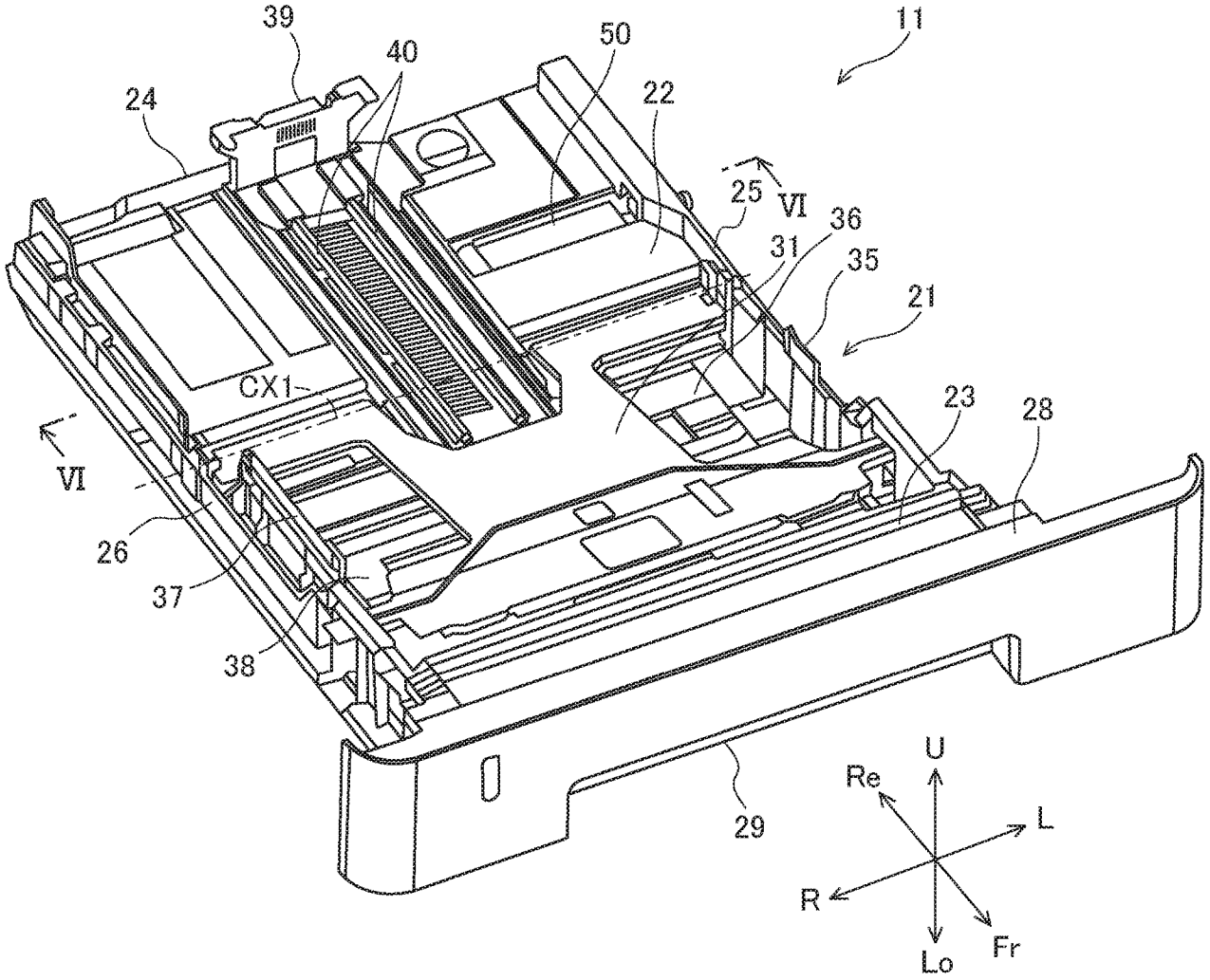
FIG. 3 is a perspective view showing a sheet feeding cassette in the present embodiment.
Figure 4:
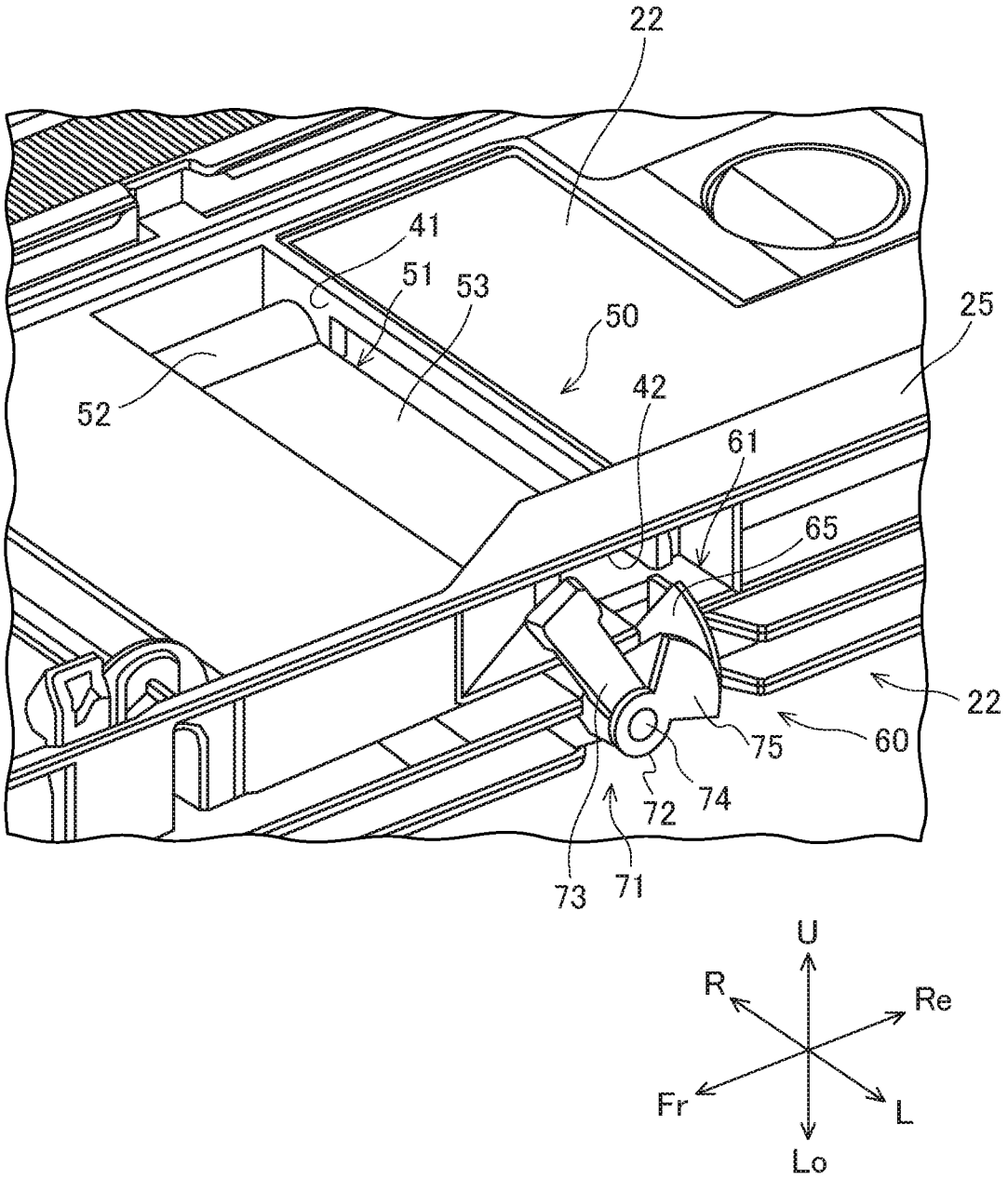
FIG. 4 is a perspective view showing a sheet taking out device and its periphery in the present embodiment.
Figure 5:
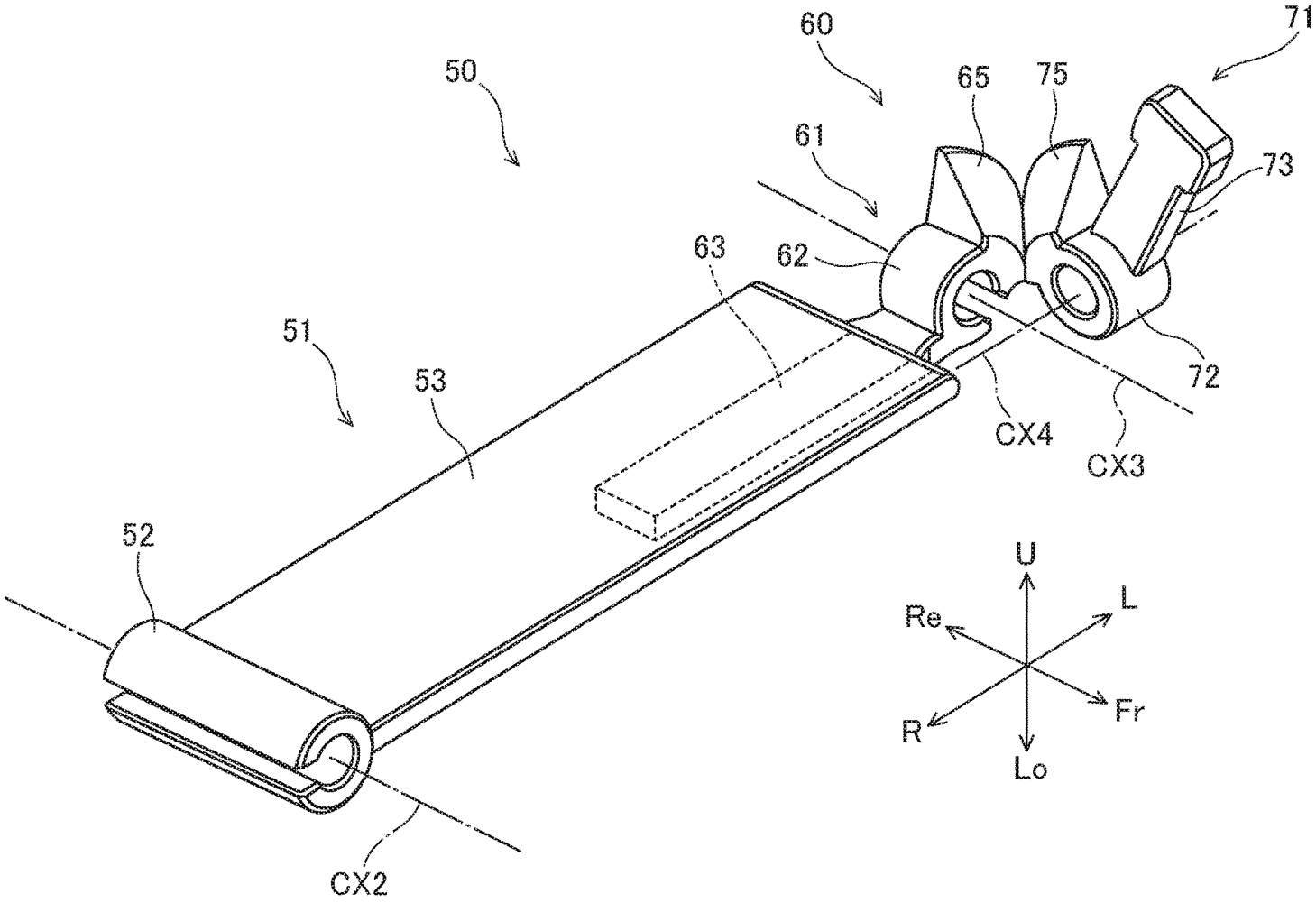
FIG. 5 is a perspective view showing the sheet taking out device in the present embodiment.
Figure 6:
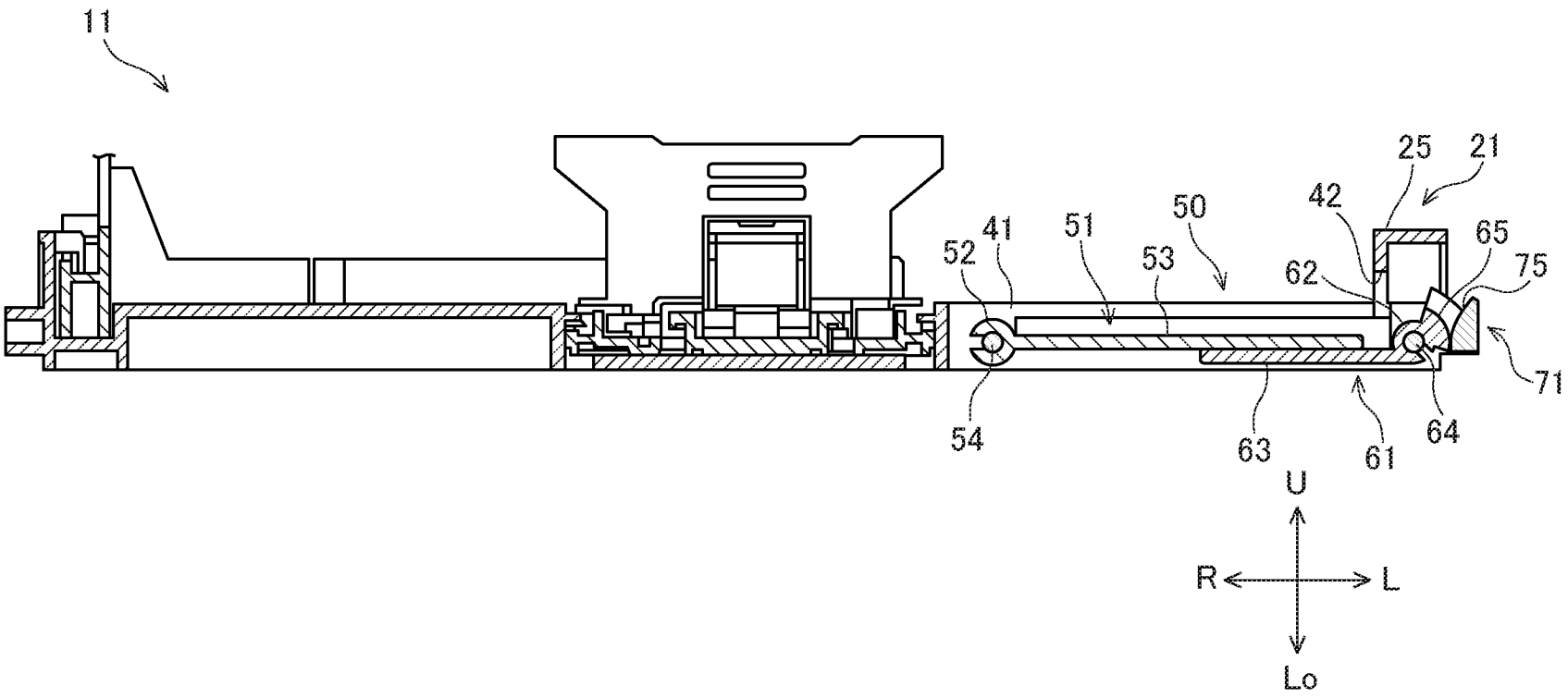
FIG. 6 is a sectional view taken along the line VI-VI in FIG. 3.

With reference to FIG. 3 to FIG. 6, the sheet feeding cassette will be described. FIG. 3 is a perspective view showing the sheet feeding cassette in the present embodiment. FIG. 4 is a perspective view showing the sheet taking out device of the sheet feeding cassette in the present embodiment and its periphery. FIG. 5 is a perspective view showing the sheet taking out device in the present embodiment. FIG. 6 is a sectional view taken along the line VI-VI in FIG. 3. In the following description, a putting-in and pulling-out direction of the cassette frame is defined as the front-and-rear direction, and a width direction of the cassette frame perpendicular to the putting-in and pulling-out direction of the cassette frame is defined as the left-and-right direction.

As shown in FIG. 3, the sheet feeding cassette 11 includes an approximately box-shaped cassette frame 21 whose upper face is opened, to which a first lift plate 31, side cursors 35 and 37, and an end cursor 39 are attached. The cassette frame 21 is attachable and detachable to and from the housing 5 in a direction perpendicular to the width direction, and a stacking space for the sheet S is formed by a rectangular bottom plate 22 in a plan view, a front plate 23, a rear plate 24 and a pair of left and right side plates 25 and 26 extending along the sheet feeding direction which are stood along the four edges of the bottom plate 22. To the front plate 23 of the cassette frame 21, a front cover 28 forming a part of the housing 5 of the printer 1 (refer to FIG. 1) is attached. The front cover 28 has a grip 29 to slid the sheet feeding cassette 11 to the printer 1 in the front-and-rear direction.

The first lift plate 31 is set on the front half portion of the bottom plate 22 of the cassette frame 21, and configured to be lifted and lowered around a first axis CX1 along the width direction perpendicular to the sheet feeding direction such that the leading end portion of the sheet S in the sheet feeding direction can be lifted up. The first lift plate 31 is partially cut out so as to avoid interference with the side cursors 35 and 37 and the end cursor 39. The rear end portion of the first lift plate 31 is supported by the pair of left and right side plates 25 and 26 of the cassette frame 21, and the front end portion of the first lift plate 31 is turned (rotated up and down) around the first axis CX1 with the rear end portion as a fulcrum. Below the first lift plate 31, a first lift mechanism 30 (refer to FIG. 1) to lift and lower the first lift plate 31 (to rotate the first lift plate 31 up and down) is provided. On the back surface of the first lift plate 31, an actuator piece is provided, and the actuator piece of the first lift plate 31 is coupled with a lift motor (not shown) of the first lift mechanism 30. The lift motor turns the first lift plate 31 to position the sheet stack S1 placed on the first lift plate 31 at a sheet feeding position.

The left side cursor 35 is for aligning the left side surface of the sheet stack S1 and the right side cursor 37 is for aligning the right side surface of the sheet stack S1. From the lower edge of the left side cursor 35, a rack 36 extends rightward along the bottom plate 22, and from the lower edge of the right side cursor 37, a rack 38 extends leftward along the bottom plate 22. The racks 36 and 38 are separated away in the left-and-right direction on the same plane, and between the left and right racks 36 and 38, a pinion gear (not shown) is held. By coupling the left and right racks 36 and 38 via the pinon gear, as one of the left and right cursors 35 and 37 moves in one direction, the other of the left and right cursors 35 and 37 moves in an opposite direction to the one direction. This moves the side cursors 35 and 37 in a separate direction or an approach direction.

The end cursor 39 is for aligning the rear end surface of the sheet stack S1, and set to a rail 40 formed on the bottom plate 22 of the cassette frame 21 in a slidable manner. The rail 40 extends forward from the rear plate 24 of the cassette frame 21 and guides the sliding of the end cursor 39 in the front-end-rear direction. In the above manner, the side cursors 35 and 37 come into contact with the left and right side surfaces of the sheet stack S1 and the end cursor 39 comes into contact with the rear end surface of the sheet stack S1 so that the sheet stack S1 in the sheet feeding cassette 11 is aligned in the front-and-rear direction and in the left-and-right direction. Additionally, the sheet stack S1 is lifted up by the first lift plate 31 and then the sheet S is fed from the sheet feeding cassette 11.

As shown in FIG. 4, in the bottom plate 22 of the cassette frame 21, a storage part 41 having a rectangular shape in a plan view is formed into a recess between the rail 40 and the left side plate 25 in the width direction and on a rear end side of the first lift plate 31 in the sheet feeding direction. The left side plate 25 of the cassette frame 21 has an opening 42 communicating with the storage part 41. In the storage part 41 and the opening 42, the sheet taking out mechanism 50 which lifts up the sheet stack S1 from the sheet feeding cassette 11 so as to be taken out it from the sheet feeding cassette 11 is set. The sheet taking out mechanism 50 includes a second lift plate 51 which is turned (rotated up and down) around a second axis CX2 (refer to FIG. 5) while lifting up the sheet stack S1 and a second lift mechanism 60 which lifts and lowers the second lift plate 51 (rotates the second lift plate 51 up and down). The second lift mechanism 60 includes a link lever 61 and an operation lever 71. The link lever 61 turns around a third axis CX3 (refer to FIG. 5) facing the second axis CX2 (refer to FIG. 5) in the width direction and extending along the sheet feeding direction to turn the second lift plate 51. The operation lever 71 is provided on the outer side surface of the left side plate 25 and operates the link lever 61.

As shown in FIG. 5 and FIG. 6, the second lift plate 51 is set in the storage part 41 of the cassette frame 21 in a turnable manner, and is configured to be lifted and lowered around the second axis CX2 along the sheet feeding direction and to lift the side edge portion of the sheet S along the sheet feeding direction. The second lift plate 51 has a base end portion 52 having a C-shape in a cross section, and a first plate-shaped portion 53 extending from the base end portion 52 and having a rectangular shape in a plan view. In the storage part 41, a supporting shaft 54 extending in the front-and-rear direction is formed near the center portion of the cassette frame 21. To the supporting shaft 54, the base end portion 52 of the second lift plate 51 is supported. The first plate-shaped portion 53 of the second lift plate 51 is formed to be wide and comes into contact with the sheet stack S1 with a wide area, so that the sheet stack S1 is hardly damaged by the first plate-shaped portion 53.

The link lever 61 is set below the second lift plate 51 so as to be turned while supporting the second lift plate 51. The link lever 61 has a base end portion 62 having a C-shape in a sectional view, a second plate-shaped portion 63 extending from the base end portion 62 and having a rectangular shape in a plan view and an arc-shaped first bevel gear 65 formed around the outer circumferential surface of the base end portion 62. In the opening 42 of the cassette frame 21, a supporting shaft 64 extending in the front-and-rear direction is formed. To the supporting shaft 64, the base end portion 62 of the link lever 61 is supported. The second plate-shaped portion 63 of the link lever 61 is formed to be narrower than the first plate-shaped portion 53 of the second lift plate 51. This makes the link lever 61 small in size.

The operation lever 71 is coupled with the link lever 61, and is in charge of the turning operation. The operation lever 71 has a base end portion 72 having a cylindrical shape, an arm portion 73 extending from the base end portion 72 and an arc-shaped second bevel gear 75 formed around the outer circumferential surface of the base end portion 72. In the opening 42, a supporting shaft 74 (refer to FIG. 4) extending in the left-and-right direction is formed. To the supporting shaft 74, the base end portion 72 of the operation lever 71 is supported. The arm portion 73 of the operation lever 71 is formed to have a size not to interfere with a cassette guide (not shown) in the housing 5 (refer to FIG. 1) at the putting-in and pulling-out of the cassette frame 21.

As described above, the link lever 61 is turned around the third axis CX3 in parallel with the front-and-rear direction, and the first bevel gear 65 is formed on the link lever 61 around the third axis CX3. The operation lever 71 turns around a fourth axis CX4 in parallel with the left-and-right direction, and the second bevel gear 75 meshed with the first bevel gear 65 of the link lever 61 is formed on the operation lever 71 around the fourth axis CX4. Then, the turning of the operation lever 71 in the front-and-rear direction around the fourth axis CX4 is changed into the turning of the link lever 61 in the left-and-right direction around the third axis CX3 via the second and first bevel gears 75 and 65. The operation lever 71 is turned along the left side plate 25, so that the operation lever 71 does not obstruct the putting-in and pulling-out of the sheet feeding cassette 11.

The second axis CX2 of the second lift plate 51 is parallel to the third axis CX3 of the link lever 61, and the first plate-shaped portion 53 of the second lift plate 51 is supported by the second plate-shaped portion 63 of the link lever 61 from the lower side. The first plate-shaped portion 53 of the second lift plate 51 extends from the base end portion 52 to near the base end portion 62 of the link lever 61, and the second plate-shaped portion 63 of the link lever 61 extends from the base end portion 62 to almost a longitudinally half portion of the first plate-shaped portion 53 of the second lift plate 51. The second plate-shaped portion 63 of the link lever 61 comes into contact with the first plate-shaped portion 53 of the second lift plate 51 at a position far from the base end portion 52 of the second lift plate 51, so that the link lever 61 makes it possible to lift up the second lift plate 51 with a small force.

In the sheet taking out mechanism 50 having the above described configuration, the turning operation of the operation lever 71 turns the second lift plate 51 via the link lever 61 between a protruding position P1 (refer to FIG. 8A) where the second lift plate 51 protrudes from the storage part 41 and a storage position P2 (refer to FIG. 7A) where the second lift plate 51 is stored in the storage part 41. When the second lift plate 51 is turned to the protruding position P1, the second lift plate 51 and the link lever 61 are crossed at right angles and the second lift plate 51 is supported by the end surface 66 of the turning side end portion of the link lever 61 (refer to FIG. 8A). Then, by the turning operation of the operation lever 71, the sheet stack S1 is lifted up from the bottom plate 22 of the sheet feeding cassette 11, and then the lifted sheet stack S1 is kept by the second lift plate 51 and the link lever 61.

Figure 7A:
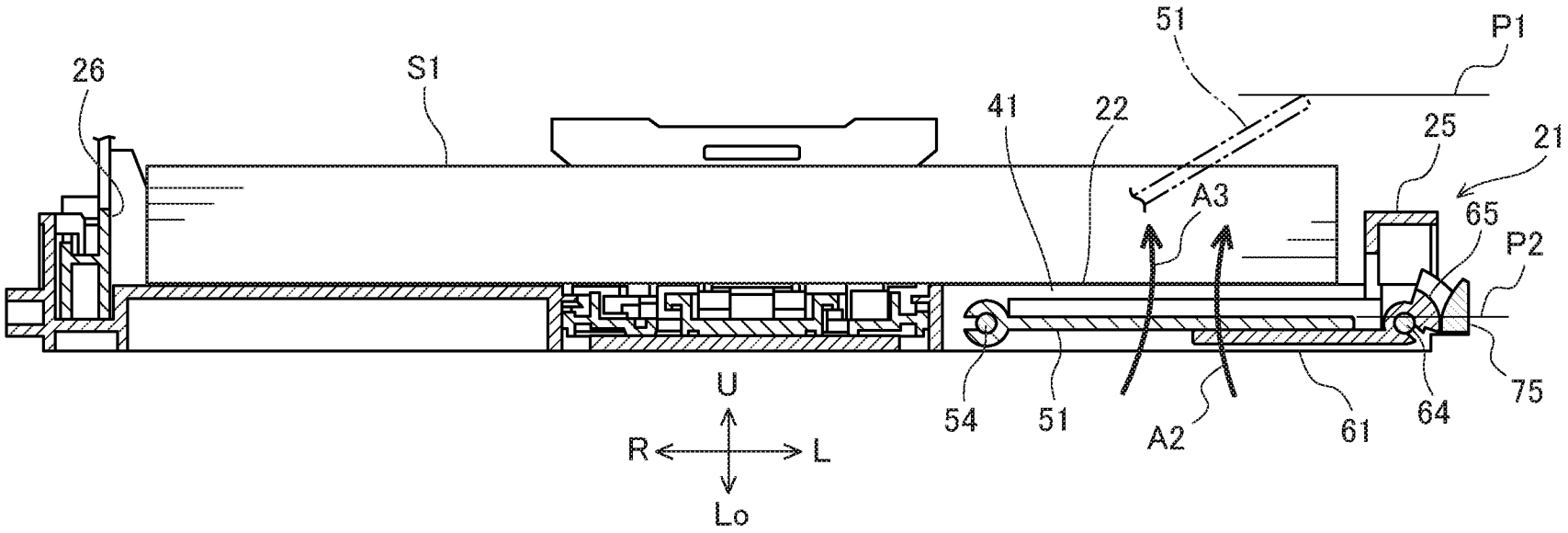
FIG. 7A is a view showing a change of the sheet stack from a setting state to a taking out state, in the present embodiment.
Figure 7B:
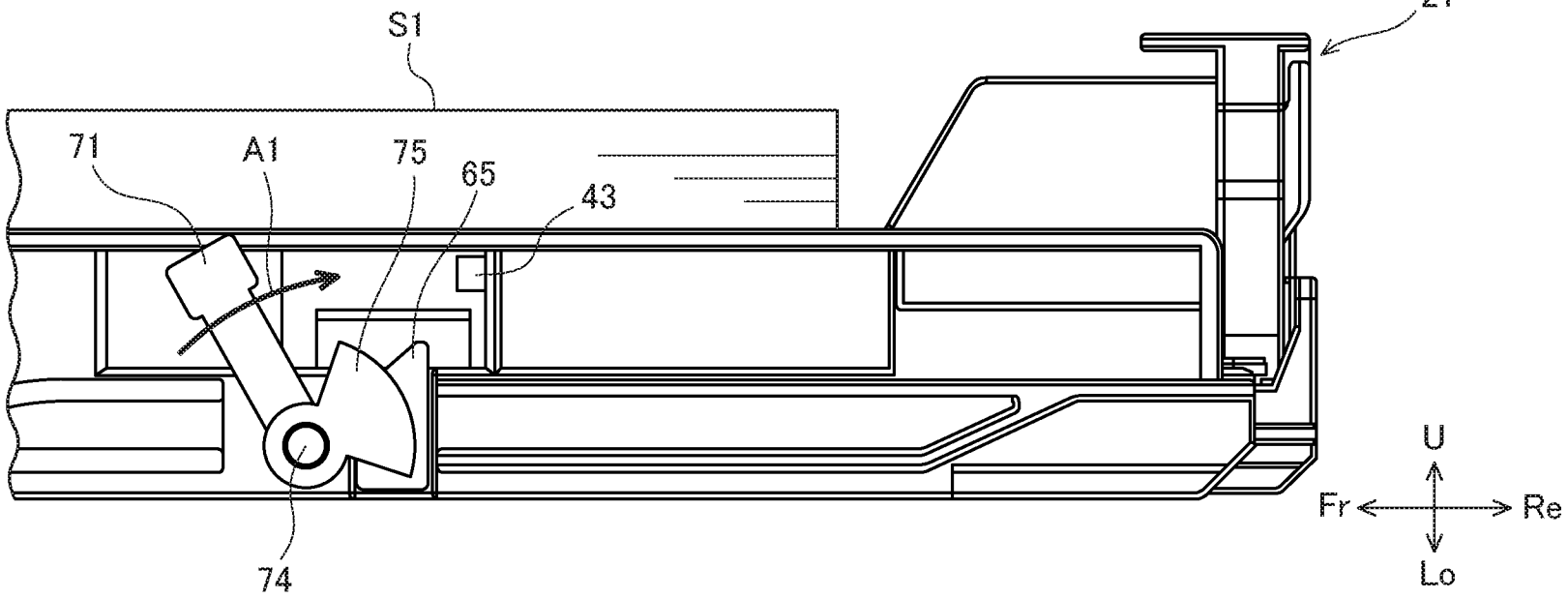
FIG. 7B is a view showing the change of the sheet stack from the setting state to the taking out state, in the present embodiment.
Figure 8A:
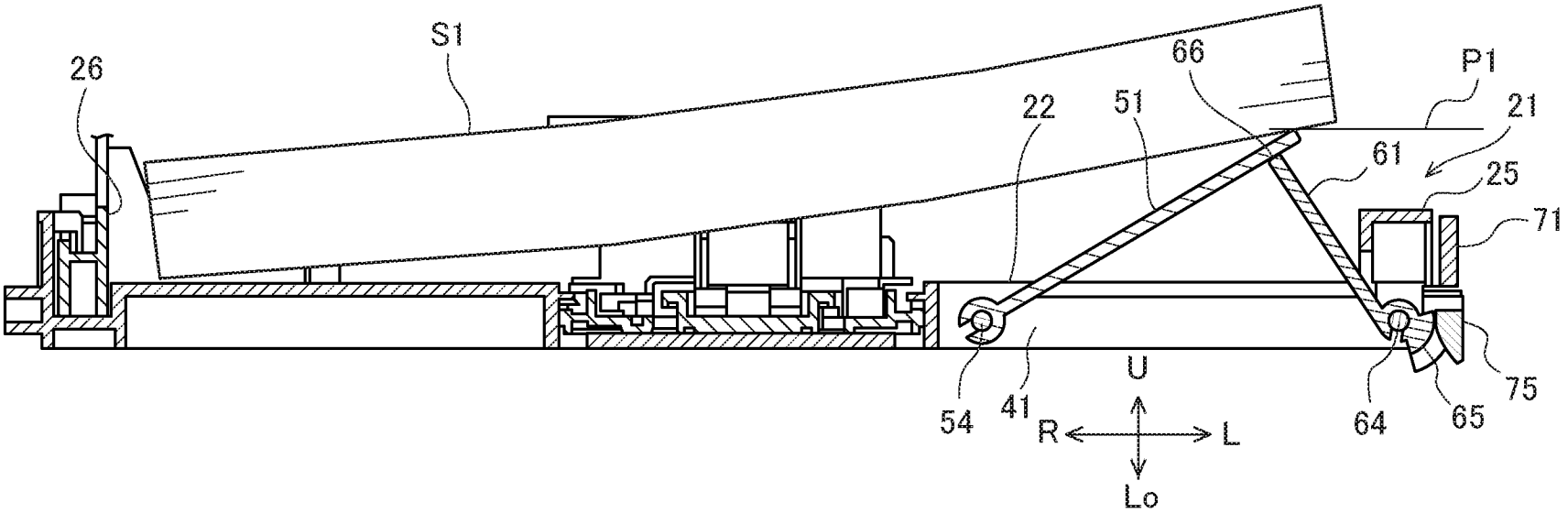
FIG. 8A is a view showing the sheet stack in the taking out state, in the present embodiment.
Figure 8B:
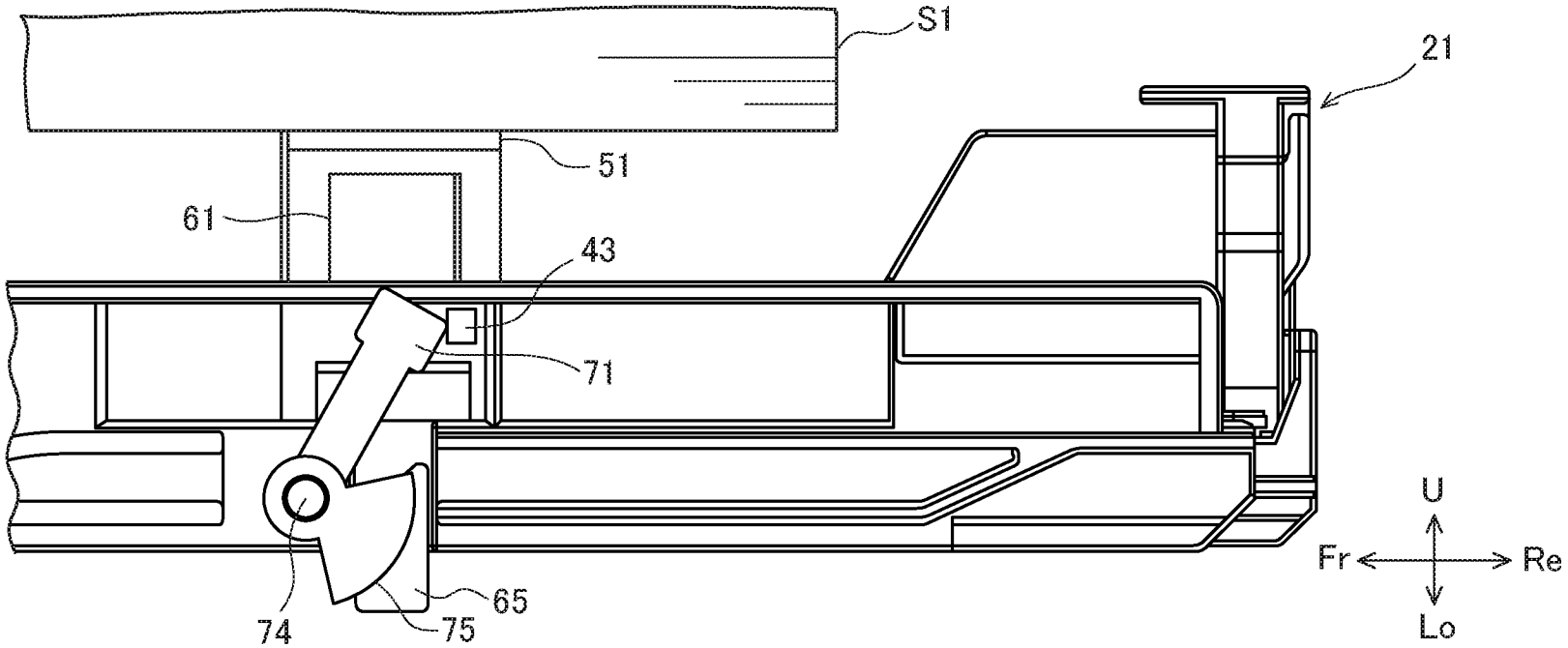
FIG. 8B is a view showing the sheet stack in the setting state, in the present embodiment.
Figure 9A:
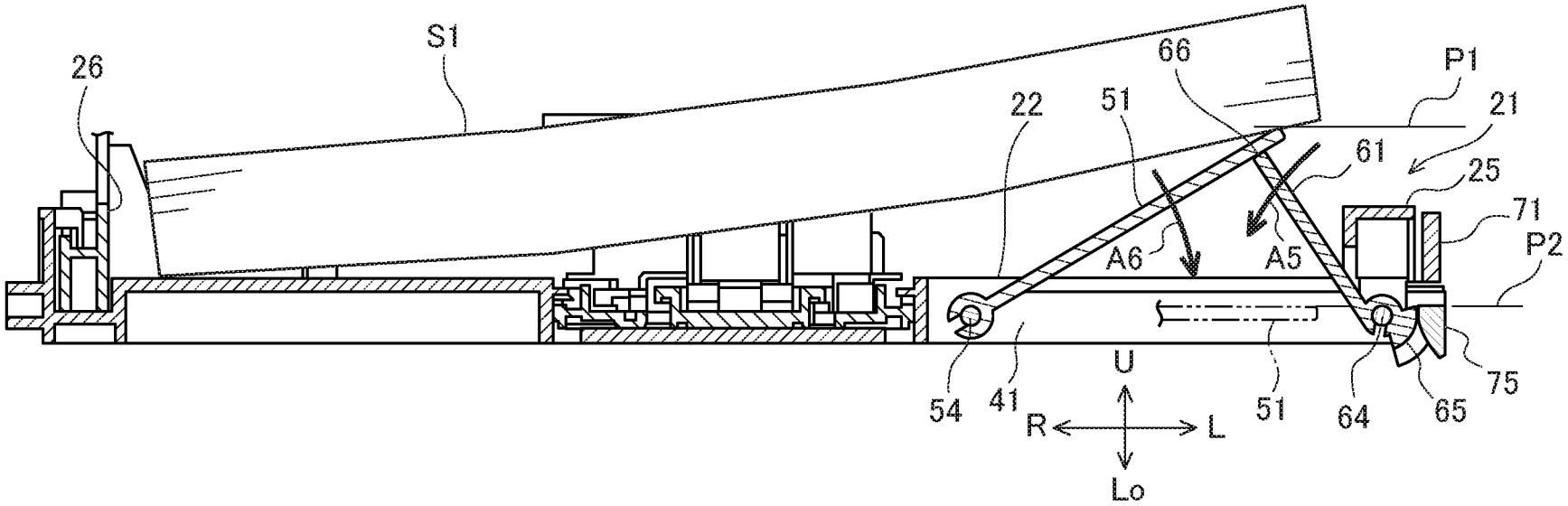
FIG. 9A is a view showing a change of the sheet stack from the setting state to the taking out state, in the present embodiment.
Figure 9B:
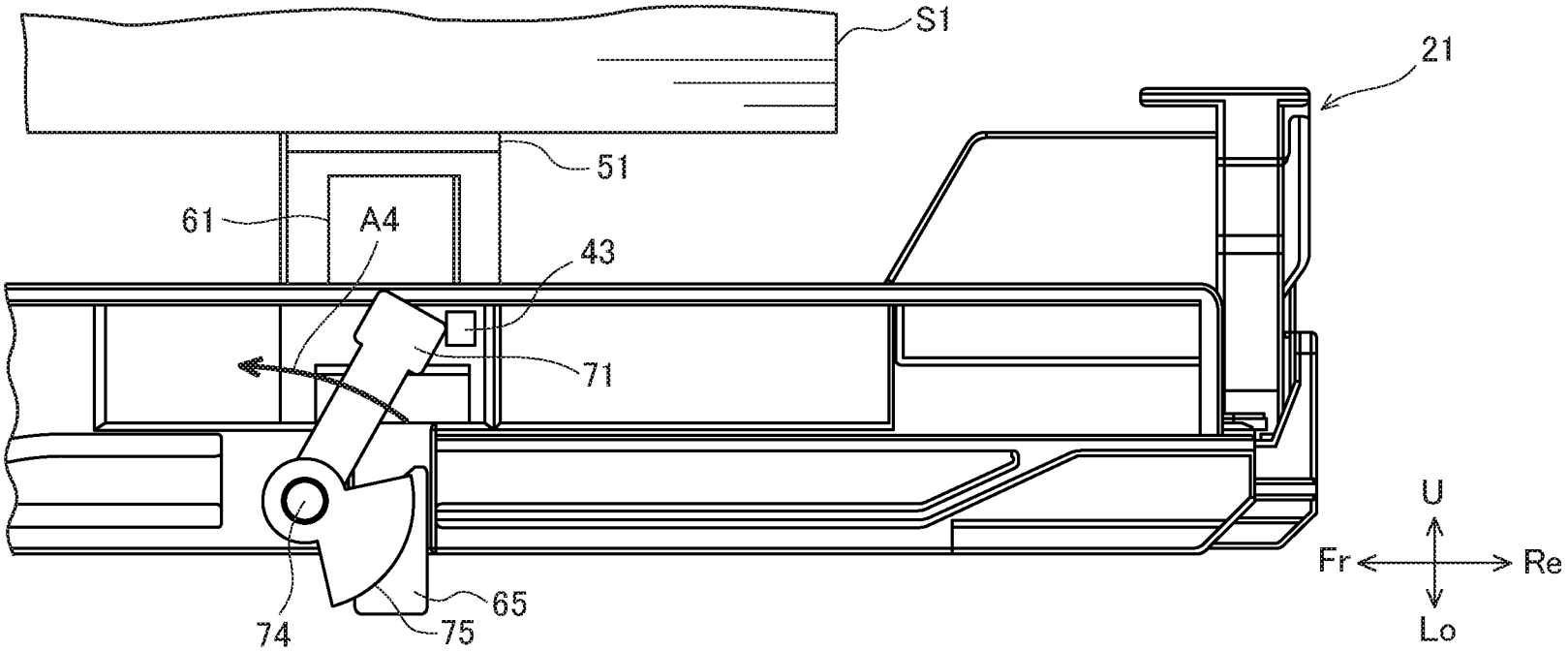
FIG. 9B is a view showing the change of the sheet stack from the setting state to the taking out state, in the present embodiment.

With reference to FIG. 7A to FIG. 9B, an taking out operation of the sheet stack will be described. FIG. 7A and FIG. 7B are views showing a change of the sheet stack from the setting state to the taking out state, in the present embodiment. FIG. 8A and FIG. 8B are views showing the sheet stack in the taking out state, in the present embodiment. FIG. 9A and FIG. 9B are views showing a change of the sheet stack from the taking out state to the setting state, in the present embodiment.

As shown in FIG. 7A and FIG. 7B, in the setting state of the sheet stack S1, the sheet stack S1 is placed on the bottom plate 22 of the cassette frame 21. In the setting state, the operation lever 71 is inclined forward, and the second lift plate 51 and the link lever 61 are stored in the storage part 41. The second lift plate 51 is positioned to the storage position P2 in the storage part 41, and the second lift plate 51 is separated away from the sheet stack S1 placed on the bottom plate 22. In a state where the sheet stack S1 is placed on the bottom plate 22 of the cassette frame 21, the spaces between the side surfaces of the sheet stack S1 and the pair of side plates 25 and 26 are so narrow that it becomes impossible to take the sheet stack S1 out of the cassette frame 21.

In the setting state, when the operation lever 71 is pushed in a direction shown by the arrow A1, the operation force of the operation lever 71 is transmitted to the link lever 61 via the second and first bevel gears 75 and 65. As the operation lever 71 is turned around the supporting shaft 74 along the left-and-right direction, as shown by the arrow A2, the link lever 61 is turned upward around the supporting shaft 64 along the front-and-rear direction. The second lift plate 51 is pushed up by the link lever 61, and the second lift plate 51 is turned upward around the supporting shaft 54 as shown by the arrow A3. Thereby, the second lift plate 51 is turned from the storage position P2 to the protruding position P1, so that the sheet stack S1 is lifted up from the bottom plate 22 of the cassette frame 21.

As shown in FIG. 8A and FIG. 8B, when the operation lever 71 is pushed in until coming into contact with a stopper 43, the second lift plate 51 is turned to the protruding position P1 while lifting the sheet stack S1 up. At this time, the end surface 66 of the turning side end portion of the link lever 61 comes into contact with the back surface of the second lift plate 51, and the second lift plate 51 and the link lever 61 are crossed at right angles. Although the end surface 66 of the link lever 61 is slightly rounded, the apex portion of the end surface 66 is formed to be flat so as to come into surface-contact with the back surface of the second lift plate 51. Thereby, the second lift plate 51 and the link lever 61 are prevented from being turned downward, and the second lift plate 51 is kept at the protruding position P1.

In detail, because the second lift plate 51 and the link lever 61 are crossed at right angles, the downward turning of the second lift plate 51 is restricted by the link lever 61, and the link lever 61 is held at the current position owing to the pressure from the second lift plate 51. That is, because the link lever 61 is oriented to a tangential direction to the turning direction of the second lift plate 51, the link lever 61 is not applied with a pressure in the turning direction from the second lift plate 51. If a load of the sheet stack S1 is applied to the link lever 61 via the second lift plate 51, the link lever 61 is not turned downward and the second lift plate 51 is kept at the protruding position P1 by the link lever 61.

The protruding position P1 of the second lift plate 51 is set to a position higher than the left side plate 25 of the cassette frame 21. Because the second lift plate 51 is positioned above the left side plate 25, it becomes possible to grip both the front and back surfaces of the sheet stack S1 on the second lift plate 51 and then take out it from the cassette frame 21 easily. In the state where the second lift plate 51 is positioned to the protruding position P1, the second lift plate 51 and the link lever 61 are self-stood without falling down. Thereby, a rock mechanism for supporting the second lift plate 51 to the protruding position P1 is not needed, and it becomes possible to make the configuration of the sheet taking out mechanism 50 simple and to reduce the cost. The end surface 66 of the link lever 61 may be curved so as to come into point-contact with the back surface of the second lift plate 51. In this case, an engagement groove with which the end surface 66 of the link lever 61 is engaged may be formed on the back surface of the second lift plate 51.

As shown in FIG. 9A and FIG. 9B, in the taking out state of the sheet stack S1, the operation lever 71 is inclined backward. In the taking out state, when the operation lever 71 is returned in a direction shown by the arrow A4, the operation force of the operation lever 71 is transmitted to the link lever 61 via the second and first bevel gears 75 and 65. As the operation lever 71 is turned around the supporting shaft 74 along the left-and-right direction, the link lever 61 is turned downward around the supporting shaft 64 along the front-and-rear direction, as shown by the arrow A5. Then, as shown by the arrow A6, the second lift plate 51 is turned downward around the supporting shaft 54 from the protruding position P1 to the storage position P2 and then returned to the setting state of the sheet stack S1.

As described above, according to the present embodiment, when the link lever 61 is turned depending on the turning operation, the second lift plate 51 supported by the link lever 61 is turned. When the second lift plate 51 is turned to the protruding position P1, the sheet stack S1 placed on the bottom plate 22 of the cassette frame 21 is lifted up by the second lift plate 51. Thereby, it becomes possible to grip the surfaces of the sheet stack S1 with fingers and to take out the sheet stack S1 from the cassette frame 21 smoothly. By providing the above sheet feeding cassette 11 in the printer 1, the sheet stack S1 can be taken out from the sheet feeding cassette 11 without being damaged so that it becomes possible to prevent a conveyance failure of the sheet S and a printing failure when the sheet stack S1 is set to the sheet feeding cassette 11 again.

In the present embodiment, the second lift plate 51 and the link lever 61 are not limited to have a plate-like shape, and may be formed into a mesh-like shape, for example.

The present embodiment has a configuration such that the link lever 61 and the operation lever 71 are coupled with via the first and second bevel gears 65 and 75, but is not limited to the above configuration. The link lever 61 and the operational lever 71 may be coupled with so as to transmit a driving force by friction.

The present embodiment has a configuration such that the third axis CX3 of the link lever 61 and the fourth axis CX4 of the operation lever 71 are crossed at right angles, but is not limited to the configuration. The third axis CX3 of the link lever 61 may be crossed to the fourth axis CX4 of the operation lever 71 diagonally.

The present embodiment has a configuration such that the link lever 61 and the operation lever 71 are formed separately, but is not limited to the configuration. The link lever 61 and the operation lever 71 may be formed integrally.

The present embodiment has a configuration such that the protruding position P1 of the second lift plate 51 is set higher than the side plates 25 and 26 of the cassette frame 21, but is not limited to the configuration. If the protruding position P1 of the second lift plate 51 is set at least higher than the bottom plate 22 of the cassette frame 21, it becomes possible to improve a performance for taking out the sheet stack S1.

The present embodiment has a configuration such that the second axis CX2 of the second lift plate 51 is parallel to the third axis CX3 of the link lever 61, but is not limited to the configuration. The second axis CX2 of the second lift plate 51 may not be parallel to the third axis CX3 of the link lever 61.

The present embodiment has a configuration such that the sheet taking out mechanism 50 is provided on a left side of the cassette frame 21, but is not limited to the configuration. The sheet taking out mechanism 50 may be provided on a right side of the cassette frame 21, or on both left and right sides of the cassette frame 21.

The present embodiment shows the printer 1 as an example of an image forming apparatus, but is not limited thereto. The image forming apparatus may be a copying machine, a facsimile or a multifunctional peripheral provided with a printing function, a copying function, a facsimile function and the other function totally.

In the present embodiment, the sheet S may be a sheet-shaped one on which the image is to be formed, and contain a plain paper, a coated paper, a tracing paper, a sheet for an over head projector (OHP), for example.

Although the present embodiment has been described, as other embodiments, a combination of the above embodiment and modified examples may be employed partially or as a whole.

The technique of the present disclosure is not limited to the above embodiments, and may be modified, substituted or deformed variously without departing from the spirit of the technical idea. Furthermore, if the technical idea can be realized in another way by a development in technology or derived technology, it may be carried out using the way. Accordingly, the claims cover all embodiment that may be contained in the scope of the technical idea.

The present disclosure has been described with respect to specific embodiments, the present disclosure is not limited to the above embodiments. The above embodiment can be modified by those skilled in the art without departing from the scope and sprit of the present disclosure.

The invention claimed is:

1. A sheet feeding cassette attached to an apparatus main body in a detachable manner and on which a sheet to be fed in a predetermined feeding direction is placed, the sheet feeding cassette comprising:

a cassette frame including a bottom plate and side plates extending in the feeding direction, the bottom plate and the side plates forming a sheet placement space;

a first lift plate disposed on the bottom plate, configured to rotate up and down around a first axis extending along a width direction perpendicular to the feeding direction, and configured to lift a leading end portion in the feeding direction of the sheet;

a second lift plate configured to rotate up and down around a second axis extending along the feeding direction and to lift a side end portion along the feeding direction of the sheet;

a first lift mechanism configured to rotate the first lift plate up and down; and a second lift mechanism configured to rotate the second lift plate up and down, wherein the second lift mechanism includes:

a link lever turned around a third axis facing the second axis in the width direction and extending in the feeding direction to turn the second lift plate; and an operation lever provided on an outer side surface of one of the side plates to operate the link lever.

2. The sheet feeding cassette according to claim 1, configured to be attached to the apparatus main body in a detachable manner in the feeding direction, wherein the operation lever is turned around a fourth axis extending along the width direction of the cassette frame.

3. The sheet feeding cassette according to claim 2, wherein the link lever is provided with a first bevel gear which rotates around the third axis, the operation lever is provided with a second bevel gear which rotates around the fourth axis, and the link lever and the operation lever are coupled with each other by an engagement of the first bevel gear with the second bevel gear.

4. The sheet feeding cassette according to claim 3, wherein the second axis is parallel to the third axis, the second lift plate is provided with a first plate-shaped portion extending from a base portion of the second lift plate, the link lever is provided with a second plate-shaped portion extending from a base portion of the link lever, the first plate-shaped portion is supported by the second plate-shaped portion from a lower side, and the second plate-shaped portion extends to a longitudinal half position of the first plate-shaped portion.

5. The sheet feeding cassette according to claim 4, wherein the cassette frame has a storage part formed into a recess in which the second lift plate can be stored, and the link lever holds the second lift plate in a protruding position where the second lift plate protrudes from the storage part, in a state where a tip end of the link lever comes into contact with a lower surface of the second lift plate at right angles.

6. The sheet feeding cassette according to claim 5, wherein a tip end of the second lift plate is positioned higher than the side plates in the protruding position.

7. An image forming apparatus comprising:

the sheet feeding cassette according to claim 1; and an image forming part which forms an image on the sheet fed from the sheet feeding cassette.

* * * * *